US008418668B2

(12) United States Patent
Shimizu

(10) Patent No.: US 8,418,668 B2
(45) Date of Patent: Apr. 16, 2013

(54) PLASMA IGNITER AND IGNITION DEVICE FOR INTERNAL COMBUSTION ENGINE

(75) Inventor: Naohiro Shimizu, Aichi (JP)

(73) Assignee: NGK Insulators, Ltd., Nagoya (JP)

( * ) Notice: Subject to any disclaimer, the term of this patent is extended or adjusted under 35 U.S.C. 154(b) by 574 days.

(21) Appl. No.: 12/702,389

(22) Filed: Feb. 9, 2010

(65) Prior Publication Data

US 2010/0212620 A1 Aug. 26, 2010

(30) Foreign Application Priority Data

Feb. 26, 2009 (JP) ..... 2009-043576
Jul. 8, 2009 (JP) ..... 2009-161858
Feb. 8, 2010 (JP) ..... 2010-025068

(51) Int. Cl.
*F02B 5/02* (2006.01)
*F02P 3/01* (2006.01)

(52) U.S. Cl.
USPC ..... 123/143 B; 123/143 R

(58) Field of Classification Search ..... 123/143 R, 123/146.5 R, 608, 620, 627, 636, 637, 143 B; 219/121.36; 315/111.21, 111.31; 313/141
See application file for complete search history.

(56) References Cited

U.S. PATENT DOCUMENTS

| | | | | |
|---|---|---|---|---|
| 2,734,143 | A * | 2/1956 | Laird | 313/131 A |
| 3,353,052 | A * | 11/1967 | Barry | 313/123 |
| 3,842,819 | A | 10/1974 | Atkins et al. | |
| 4,493,297 | A | 1/1985 | McIlwain et al. | |
| 4,914,344 | A | 4/1990 | Watanabe et al. | |
| 5,456,241 | A | 10/1995 | Ward | |
| 6,060,821 | A * | 5/2000 | Suzuki et al. | 313/141 |
| 6,474,321 | B1 * | 11/2002 | Suckewer et al. | 123/620 |
| 6,796,299 | B2 * | 9/2004 | Isono | 123/627 |
| 7,443,088 | B2 * | 10/2008 | Lykowski | 313/123 |
| 7,467,612 | B2 * | 12/2008 | Suckewer et al. | 123/143 R |
| 7,895,994 | B2 * | 3/2011 | Yamada et al. | 123/618 |
| 8,186,321 | B2 * | 5/2012 | Suckewer et al. | 123/143 R |
| 2007/0062502 | A1 * | 3/2007 | Suckewer et al. | 123/620 |
| 2009/0126668 | A1 | 5/2009 | Shiraishi et al. | |
| 2009/0194513 | A1 * | 8/2009 | Suckewer et al. | 219/121.59 |
| 2011/0309749 | A1 * | 12/2011 | Suckewer et al. | 315/111.21 |
| 2012/0048250 | A1 * | 3/2012 | Shimoda et al. | 123/636 |

FOREIGN PATENT DOCUMENTS

| | | | |
|---|---|---|---|
| CA | 964 539 | A1 | 3/1975 |
| DE | 10 2006 037 038 | A1 | 2/2008 |
| EP | 2 025 927 | A2 | 2/2009 |
| JP | 64-36981 | | 2/1989 |
| JP | 5-36463 | | 2/1993 |
| JP | 2000-110697 | | 4/2000 |
| JP | 2009-121406 | | 6/2009 |

* cited by examiner

*Primary Examiner* — Thomas Moulis
(74) *Attorney, Agent, or Firm* — Burr & Brown

(57) ABSTRACT

To provide a plasma igniter capable of generating a discharge such as a pulse streamer discharge in a large region even by application of a low voltage, implementing powerful ignition by pulse voltage application in two or more stages, improving an air-fuel ratio (A/F), and reducing a $CO_2$ emission amount. A plasma igniter includes an igniter part having a combustion chamber, and a discharge part arranged in such a manner that its discharge tip end is exposed to the combustion chamber. The discharge tip end has a column-shaped anode, an annular cathode arranged to be a predetermined interval away from an anode tip end part, and an annular floating electrode arranged between the anode tip end part and the cathode.

8 Claims, 16 Drawing Sheets

PLASMA IGNITER AND IGNITION DEVICE FOR INTERNAL COMBUSTION ENGINE

FIELD OF THE INVENTION

The present invention relates to a plasma igniter suitable for an internal-combustion engine such as a gasoline engine, and an ignition device for the internal-combustion engine.

BACKGROUND OF THE INVENTION

Conventionally, at the time of engine ignition, a method of igniting a mixture gas using a spark plug (spark injection (SI) plug) is employed (see patent document 1, for example). The SI plug is a well-known electric component used to ignite the mixture gas in a combustion chamber of an engine, and generally includes a center electrode, an insulator provided around an outer circumference of the center electrode, a mounting screw part provided around an outer circumference of the insulator and mounted on the engine, and a ground electrode connected to an end part of the mounting screw.

When a high voltage is applied between the center electrode and the ground electrode of the SI plug, insulation between the electrodes is destroyed and a discharge phenomenon is generated, and an electric spark is generated. The mixture gas can be ignited by energy of this electric spark.

[Patent Document 1] Japanese Patent Application Laid-Open No. 64-36981

SUMMARY OF THE INVENTION

Meanwhile, when it is assumed that the pulse voltage is applied between the electrodes at predetermined intervals several times repeatedly with the general SI plug to generate non-equilibrium plasma containing active radical species to implement ignition, there is a problem that the generated active radical species is small in amount and it is difficult to implement efficient ignition and combustion because a discharge region is limited to the space between the center electrode and the ground electrode.

It is considered to take measures against the above problem by enlarging a plug gap of the SI plug. When the SI plug having the large plug gap is used, the discharge region is enlarged, so that the ignition can be surely expected. However, when the plug gap was enlarged too much, it was necessary to apply a high voltage to ensure the ignition. That is, when the internal-combustion engine (igniter) is operated by use of the conventional SI plug, the discharge region can be enlarged (or reduced) only by enlarging (or reducing) the plug gap of the SI plug, so that a degree of freedom of application is low, and there is a case where it cannot be preferably applied to an ignition and combustion method in which a pulse voltage is applied to generate non-equilibrium plasma for ignition.

The present invention has been made in view of the problem in the background technique, and it is an object of the present invention to provide a plasma igniter capable of generating a discharge such as a pulse streamer discharge in a large region even by application of a low voltage, implementing powerful ignition by pulse voltage application in two or more stages, improving an air-fuel ratio (A/F), and reducing a $CO_2$ emission amount.

After earnest investigation to solve the above problem, the present inventor has found that the above problem can be solved by the following configurations and completed the present invention.

That is, the present invention provides a plasma igniter and an ignition device of an internal-combustion engine as follows.

[1] A plasma igniter including an igniter part having a combustion chamber, and a discharge part arranged to expose its discharge tip end to the combustion chamber, in which the discharge tip end of the discharge part includes a column-shaped anode, an annular or cylindrical cathode arranged at one tip end part of the discharge part to be spaced a predetermined distance away from the tip end part of the anode, and an annular or cylindrical floating electrode arranged between the tip end part of the anode and the tip end part of the cathode.

[2] The plasma igniter described in [1], in which the cathode and the floating electrode are arranged concentrically around the tip end part of the anode, respectively.

[3] The plasma igniter described in [1] or [2], in which a plurality of the floating electrodes are arranged between the tip end part of the anode and the cathode.

[4] The plasma igniter described in any one of [1] to [3], in which the discharge tip end of the discharge part further includes a ceramic base material to mutually fix the anode, the cathode, and the floating electrode.

[5] The plasma igniter described in any one of [1] to [4], in which a shape of the discharge tip end of the discharge part is a recessed shape.

[6] An ignition device for an internal-combustion engine including an electrode structure body including an anode, a cathode and a floating electrode, and a pulse power supply to apply a pulse voltage between the anode and the cathode, in which a discharge contributing part of the cathode is positioned to be a first distance away from a discharge end of the anode along a surface of the electrode structure body, a discharge contributing part of the floating electrode is positioned to be a second distance shorter than the first distance, away from the discharge end of the anode along the surface of the electrode structure body, and interposed between the discharge end of the anode and the discharge contributing part of the cathode, and the pulse power supply applies a relatively low pulse voltage between the anode and the cathode to generate a pulse discharge in a first discharge region between the discharge end of the anode and the discharge contributing part of the floating electrode, and then applies a relatively high pulse voltage thereto to generate a pulse discharge in a second discharge region between the discharge end of the anode and the discharge contributing part of the cathode.

[7] The ignition device for the internal-combustion engine described in [6], in which the electrode structure body further includes a cover made of ceramics produced by burning a film-shaped compact formed by gel-casting method to cover the discharge end of the anode.

[8] The ignition device for the internal-combustion engine described in [6] or [7], in which the anode includes a bar-shaped part, and a bar end of the bar-shaped part of the anode is the discharge end of the anode, and the discharge contributing part of the cathode and the discharge contributing part of the floating electrode are arranged concentrically around the bar end of the bar-shaped part.

[9] The ignition device for the internal-combustion engine described in [6] or [7], in which the anode includes a sheet-shape part, and a sheet end of the sheet-shaped part of the anode is the discharge end of the anode, and the discharge contributing part of the cathode and the discharge contributing part of the floating electrode extend, keeping constant distances from the sheet end of the sheet-shaped part.

[10] The ignition device for the internal-combustion engine described in any one of [6] to [9], in which a plurality of the floating electrodes are interposed between the discharge end of the anode and the discharge contributing part of the cathode.

[11] The ignition device for the internal-combustion engine described in any one of [6] to [10], in which the electrode structure body further includes a base material made of ceramics to mutually fix the anode, the cathode, and the floating electrode.

[12] The ignition device for the internal-combustion engine described in any one of [6] to [11], in which a recessed part is formed in a surface of the electrode structure body.

[13] An ignition device for an internal-combustion engine including an electrode structure body including an anode, a cathode, a floating electrode and a dielectric barrier, and a pulse power supply to apply a pulse voltage between the anode and the cathode, in which a discharge contributing part of the cathode is positioned to be a first distance away from a discharge end of the anode along a surface of the electrode structure body, a discharge contributing part of the floating electrode is positioned to be a second distance shorter than the first distance, away from the discharge end of the anode along the surface of the electrode structure body, and interposed between the discharge end of the anode and the discharge contributing part of the cathode, the dielectric barrier is arranged between the anode and the floating electrode to shield the discharge contributing part of the cathode and the discharge contributing part of the floating electrode from the discharge end of the anode, and has an opening at a position so as not to hinder the shielding of the discharge contributing part of the cathode and the discharge contributing part of the floating electrode from the discharge end of the anode, and the pulse power supply applies a relatively low pulse voltage between the anode and the cathode to generate a pulse discharge in a first discharge region between the discharge end of the anode and the discharge contributing part of the floating electrode, and then applies a relatively high pulse voltage thereto to generated a pulse discharge in a second discharge region between the discharge contributing part of the floating electrode and the discharge contributing part of the cathode.

A plasma igniter and an ignition device for an internal-combustion engine can generate a discharge such as a pulse streamer discharge in a large region even by application of a low voltage, implement powerful ignition by pulse voltage application in two or more stages, improve an air-fuel ratio (A/F), and reduce a $CO_2$ emission amount.

DETAILED DESCRIPTION OF THE INVENTION

Hereinafter, as embodiments according to the present invention will be described, it is to be understood that the present invention is not limited to the following embodiments and that modifications and variations added to the following embodiments may fall within the scope of the present invention, based on ordinary knowledge of those skilled in the art, without departing from the spirit of the present invention.

<Structure of Plasma Igniter>

Figure 1:
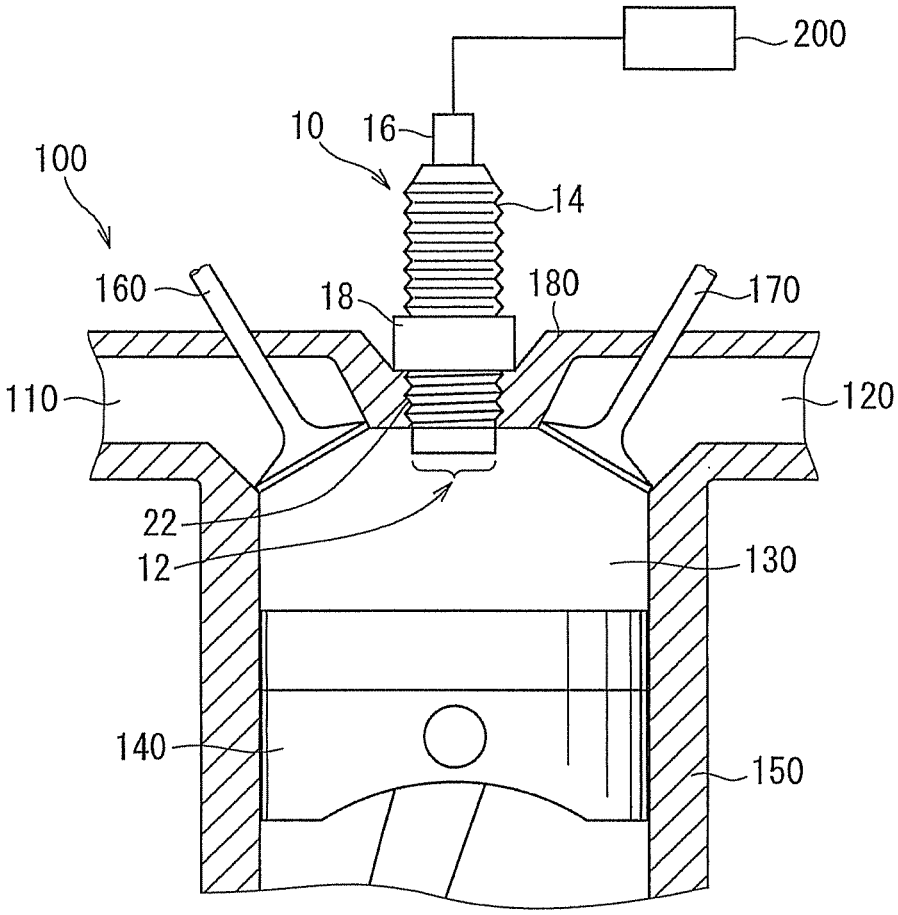
FIG. 1 is a schematic view showing one embodiment of a plasma igniter of the present invention.

FIG. 1 is a schematic view showing one embodiment of a plasma igniter according to the present invention. As shown in FIG. 1, the plasma igniter (gasoline engine) of this embodiment includes an igniter part 100 having a combustion chamber 130, and a discharge part 10 arranged such that its discharge tip end 12 is exposed to the combustion chamber 130.

First, a fuel (mixture gas) is introduced into the combustion chamber 130 through an inlet pipe 110 and an inlet valve 160, a pulse voltage generated in an ignition power supply (pulse power supply) 200 is applied between an anode (not shown) and a cathode through a terminal 16 of the discharge part 10 (spark plug). In addition, the combustion chamber 130 means a space in a cylinder, that is, a space enclosed by an inner wall surface of a cylinder 150, the inlet valve 160, an outlet valve 170, and an upper surface of a piston 140 in the igniter part 100.

When the pulse voltage is applied between the anode and cathode of the discharge part 10, non-equilibrium plasma is generated between the discharge tip end 12 of the discharge part 10 and the upper surface of the piston 140, and then the mixture gas burns in the whole combustion chamber 130. When the mixture gas burns, a generated exhaust gas is discharged outside through the outlet valve 170 and an outlet pipe 120, and a mixture gas is introduced into the combustion chamber 130 again.

The discharge part 10 (spark plug) includes a terminal 16, the anode connected to the terminal 16, and an insulator 14 arranged around an outer circumference of the anode. The insulator 14 insulates the anode from the igniter part 100. A main metal fitting 18 is arranged around an outer circumference of the insulator 14, and has a screw part 22 which enables the discharge part 10 to be fixed to the igniter part 100 in such a manner that the discharge tip end 12 is exposed to the combustion chamber 130.

<First Embodiment of Discharge Part>

(Structure of Discharge Part)

Figure 2:
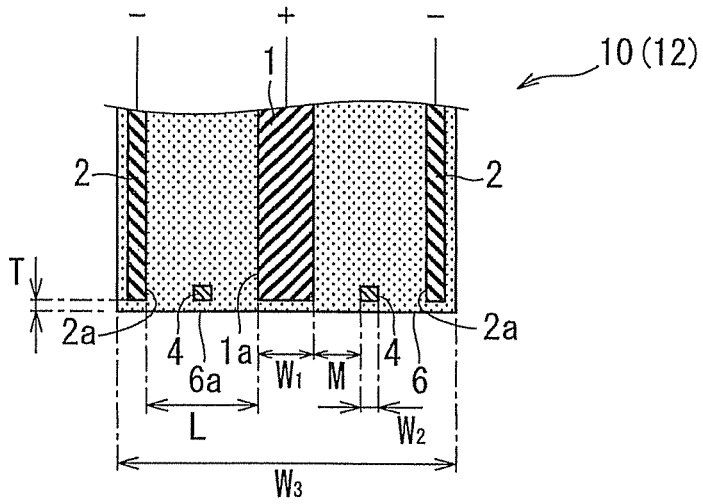
FIG. 2 is a partial cross-sectional view schematically showing a first embodiment of a discharge part used in a plasma igniter of the present invention.

FIG. 2 is a partial cross-sectional view schematically showing a first embodiment of a discharge part used in a plasma igniter according to the present invention. As shown in FIG. 2, a column-shaped (bar-shaped) anode 1 is arranged in the discharge tip end 12 of the discharge part. In addition, at the one tip end part (anode tip end part 1*a*) of the anode 1 in an axial direction, an annular (or cylindrical) cathode 2 is arranged so as to be a predetermined distance apart from the anode tip end part 1 a. Thus, an annular (or cylindrical) floating electrode 4 is arranged between the anode tip end part 1*a* and the cathode 2. In addition, the cathode 2 and the floating electrode 4 are arranged concentrically around the center of the anode tip end part 1*a*, respectively. The floating electrode 4 is not electrically connected to either the anode 1 or the cathode 2, and capable of having a potential different from those of the anode 1 and the cathode 2.

The anode tip end part 1*a* contributing to the pulse discharge in the anode 1 and a cathode tip end part 2*a* contributing to the pulse discharged in the cathode 2 are separated by a distance L along a surface of the discharge part 10 (a bottom surface 6*a* of a cylindrical base material 6 in this embodiment). In addition, when the cathode 2 is cylindrical (more generally sheet-shaped or its modification), a part contributing to the pulse discharge (hereinafter, referred to as the "discharge contributing part") is only the cathode tip end part 2*a* occupying one part of the cathode 2, but when the cathode 2 is annular (more generally bar-shaped or its modification), the discharge contributing part is roughly the whole part of the cathode 2.

In addition, the anode tip end part 1*a* and the floating electrode 4 are separated by a distance M along the surface of the discharge part 10 (the bottom surface 6*a* of the cylindrical base material 6 in this embodiment). The distance M is shorter than the distance L (M<L), and the floating electrode 4 is interposed between the anode tip end part 1*a* and the cathode tip end part 2*a*. In addition, when the floating electrode 4 is annular (more generally bar-shaped or its modification), a discharge contributing part is roughly the whole part of the floating electrode 4, but when the floating electrode 4 is cylindrical (more generally bar-shaped or its modification), the discharge contributing part is only the floating electrode tip end part occupying one part of the floating electrode 4. In the latter case, the anode tip end part 1*a* and the floating electrode tip end part are separated by a distance shorter than the distance L along the surface of the discharge part 10 (the bottom surface 6*a* of the cylindrical base material 6 in this embodiment), and the floating electrode tip end part is interposed between the anode tip end part 1*a* and the cathode tip end part 2*a*.

A positional relationship between the discharge contributing parts of the anode, the cathode and the floating electrode is important to generate a two-stage pulse discharge as described below. That is, the positional relationship of the discharge contributing part of the floating electrode interposed between the discharge contributing part of the anode and the discharge contributing part of the cathode is important. Therefore, when the positional relationship is satisfied, the stereoscopic shapes of the anode, the cathode and the floating electrode can be changed. Especially, the stereoscopic shape except for the discharge contributing part is changed due to a feeding reason of the pulse voltage to the discharge contributing part and due to an assembling reason of the discharge part 10.

The discharge tip end 12 of the discharge part 10 includes the ceramic base material 6 for fixing the anode 1, the cathode 2 and the floating electrode 4, keeping their mutual distances. The kind of the ceramics of the base material is not limited in particular, but alumina, zirconia, yttria, ceria, and titania are preferable materials from the viewpoint of ensuring insularity and the like.

When it is assumed that the plasma igniter is a general car gasoline engine, a thickness T of the base material 6 to cover the anode tip end part 1*a*, the end part of the cathode 2, and the end part of the floating electrode 4 is preferably 0.1 to 1.5 mm, and more preferably 0.2 to 0.5 mm. In addition, a width $W_1$ of the anode tip end part 1*a* is preferably 0.2 to 2.0 mm and more preferably 0.5 to 1.0 mm. A width $W_2$ of the floating electrode 4 is preferably 0.2 to 2.0 mm and more preferably 0.5 to 1.0 mm. In addition a distance (length) from the anode tip end part 1*a* to the cathode 2 is preferably 1.0 to 15.0 mm and more preferably 3.0 to 6.0 mm.

The discharge part 10 is an electrode structure body including at least the anode 1, the cathode 2 and the floating electrode 4, and desirably also including the base material 6 and the like.

(Generation of Pulse Discharge)

Figure 3:
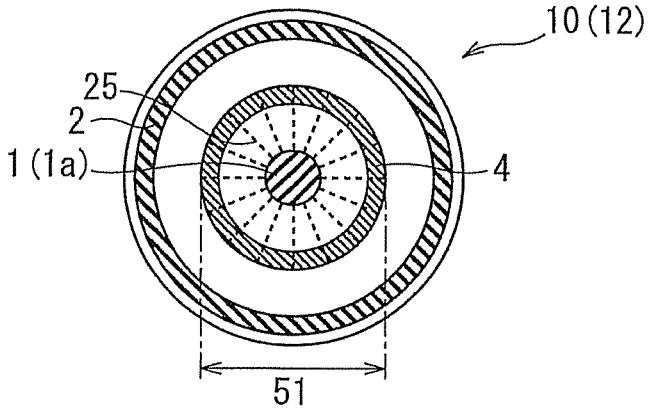
FIG. 3 is a schematic view showing one example of a state where a discharge is generated in a first discharge region.
Figure 4:
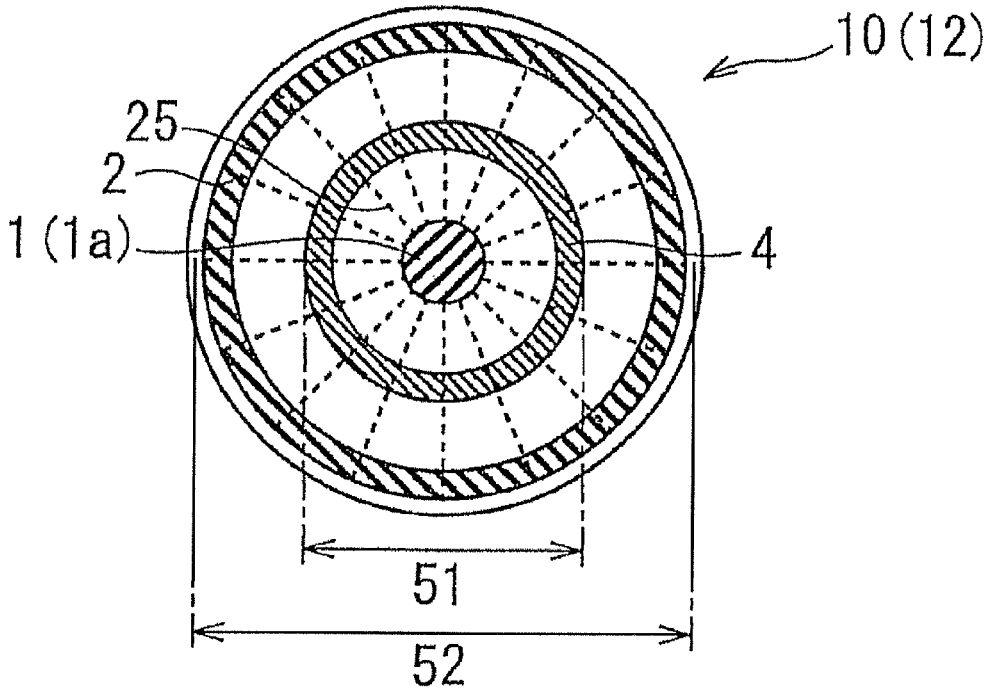
FIG. 4 is a schematic view showing one example of a state where a discharge is generated in a second discharge region.

Next, a discharge state in the discharge part will be described with reference to FIGS. 3 and 4. FIG. 3 is a schematic view showing one example of a discharged state in a first discharge region. In addition, FIG. 4 is a schematic view showing one example of a discharged state in a second discharge region. As shown in FIG. 3, when a relatively low pulse voltage is applied from the ignition power supply 200 between the anode 1 and the cathode 2, a pulse discharge is generated between the anode tip end part 1*a* and the floating electrode 4 (a first discharge region 51). In an initial stage (first stage), it is preferable that a fine pulse streamer discharge be generated several times repeatedly, and a streamer 25 be grown in the first discharge region 51, for example.

In addition, as shown in FIG. 4, when a relative high pulse voltage is applied from the ignition power supply 200 between the anode 1 and the cathode 2, a pulse discharge is generated between the anode tip end part 1*a* and the cathode 2 (a second discharge region 52). In a second stage following the above initial stage, it is preferable that a pulse streamer discharge or an arc discharge be generated, a streamer 35 be grown in the second discharge region 52, and the ignition and combustion be performed in short bursts using non-equilibrium plasma containing a large amount of radical active species generated in the initial stage. In addition, the fine pulse streamer discharge, the pulse streamer discharge and the arc discharge will be described in detail below.

(Comparison between Conventional SI Plug and Plasma Igniter According to the Present Invention)

Conventionally, when a mixture gas is ignited with the SI plug, the plug gap of the SI plug is enlarged to expand a discharge region in order to increase an amount of active radical species generated. Meanwhile, in the discharge part of the plasma igniter according to the present invention, as shown in FIG. 3, the floating electrode 4 is disposed between the anode tip end part 1*a* and the cathode 2 in the discharge tip end 12, and a planar discharge region is formed. In addition, since the floating electrode 4 is disposed, the pulse discharge can be generated in stages by adjusting the applied pulse voltage, and the ignition and combustion can be surely implemented without applying a high voltage as in the case where the plug gap of the SI plug is enlarged.

Figure 15:
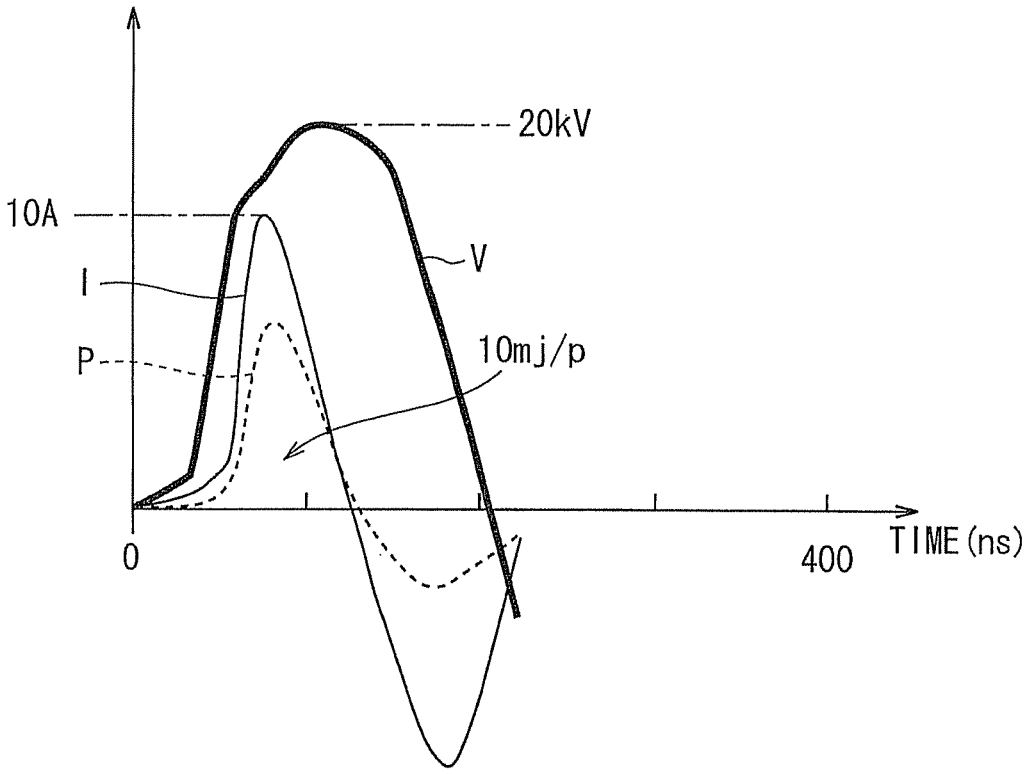
FIG. 15 is a graph showing a chronological change of a voltage (V), current (I), and power (P) when a pulse voltage is applied to the discharge part shown in FIG. 14.
Figure 16:
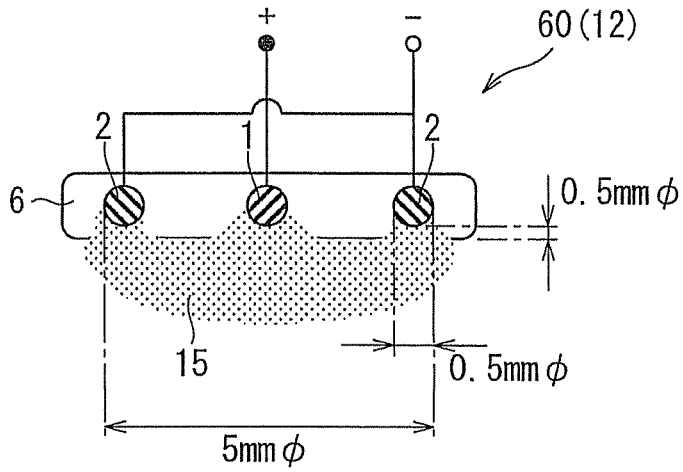
FIG. 16 is a schematic view showing one example of a state where a plus voltage is applied to a conventional discharge part (spark plug).
Figure 17:
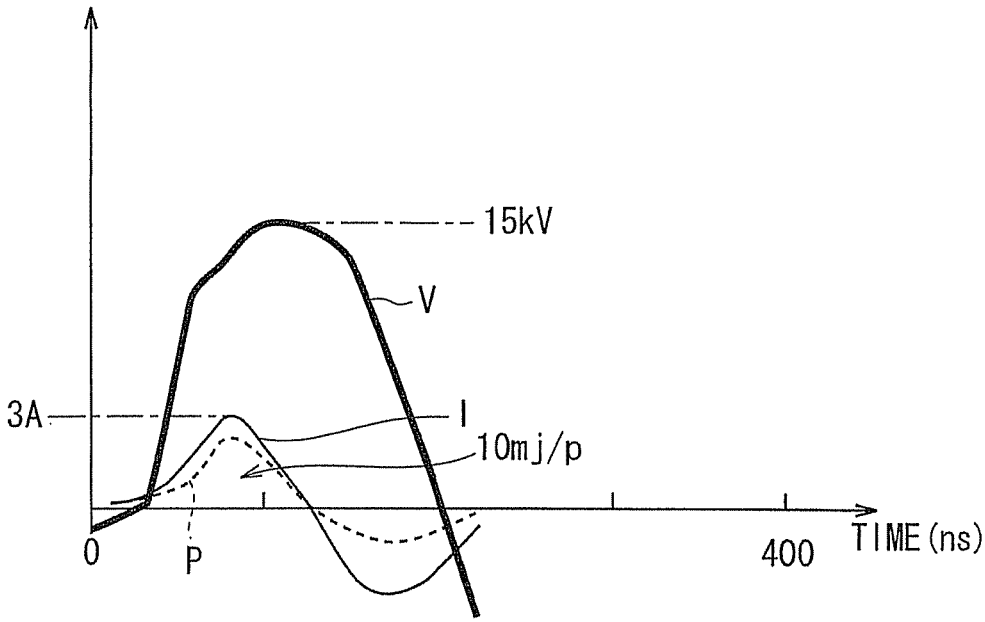
FIG. 17 is a graph showing a chronological change of a voltage (V), a current (I), and a power (P) when a plus voltage is applied to the discharge part (spark plug) shown in FIG. 16

When a pulse voltage of 15 kV is applied to a conventional discharge part 60 having a configuration shown in FIG. 16, as shown in FIG. 17, a generated power per pulse is only 3 mJ/p and a current value is only 3A. Meanwhile, when a pulse voltage of 20 kV is applied to the discharge part 10 shown in FIG. 14 according to this embodiment, as shown in FIG. 15, a generated power per pulse is 10 mJ/p and a current value is as great as 10A. Consequently, with the plasma igniter according to the present invention including the discharge part having the configuration shown in FIG. 14, non-equilibrium plasma containing a large amount of active radical species can be efficiently generated based on the applied pulse voltage.

(Discharge State)

Figure 21:
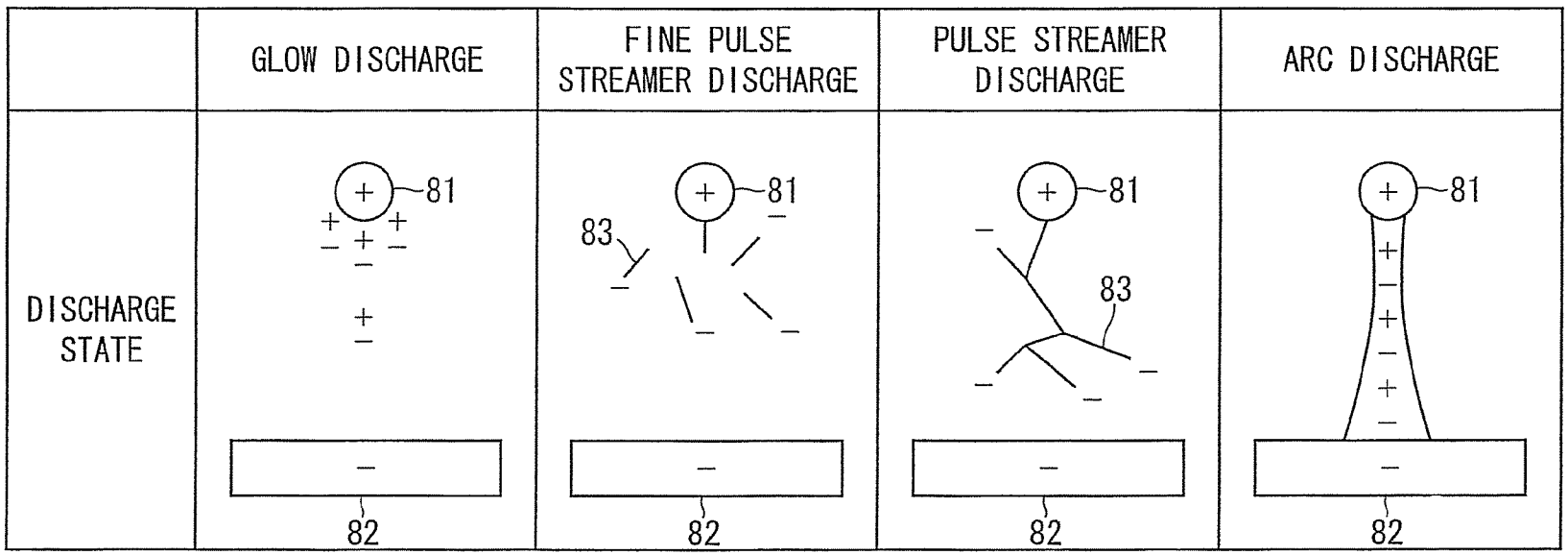
FIG. 21 is a schematic view showing discharge states.

FIG. 21 is a schematic view showing discharge states caused by application of electric pulses to an electrode pair. As shown in FIG. 21, when a pulse width of the electric pulse reaches a predetermined value, a glow discharge is caused in such a manner that a new positive ion is generated by a secondary electron emitted when a positive ion collides against a cathode 82.

Meanwhile, when a rise rate of a voltage V (voltage rise rate (dV/dt)) at the time of rise of the electric pulse is approximately 30 to 500 kV/μs, a streamer 83 starts growing from an anode 81 to the cathode 82. Then, the growth of the streamer 83 ends in an initial stage in which the short streamers 83 are dispersed between the anode 81 and the cathode 82. Meanwhile, when the pulse width is further increased, the streamer 83 largely grows and a long branched streamer 83 is provided between the anode 81 and the cathode 82. In addition, when the pulse width is further increased, the current crowds locally, and the arc discharge is caused eventually.

In the above description, the term "approximately" is added to the range of the voltage rise rate (dV/dt) because the range varies depending on the specific configuration of the discharge part (spark plug) such as the interval between the anode 81 and the cathode 82, and structures of the anode 81 and the cathode 82. Therefore, whether or not the fine pulse streamer discharge is generated is to be determined by observing the actual discharge as well as based on the voltage rise rate (dV/dt) at the time of rise.

Figure 22:
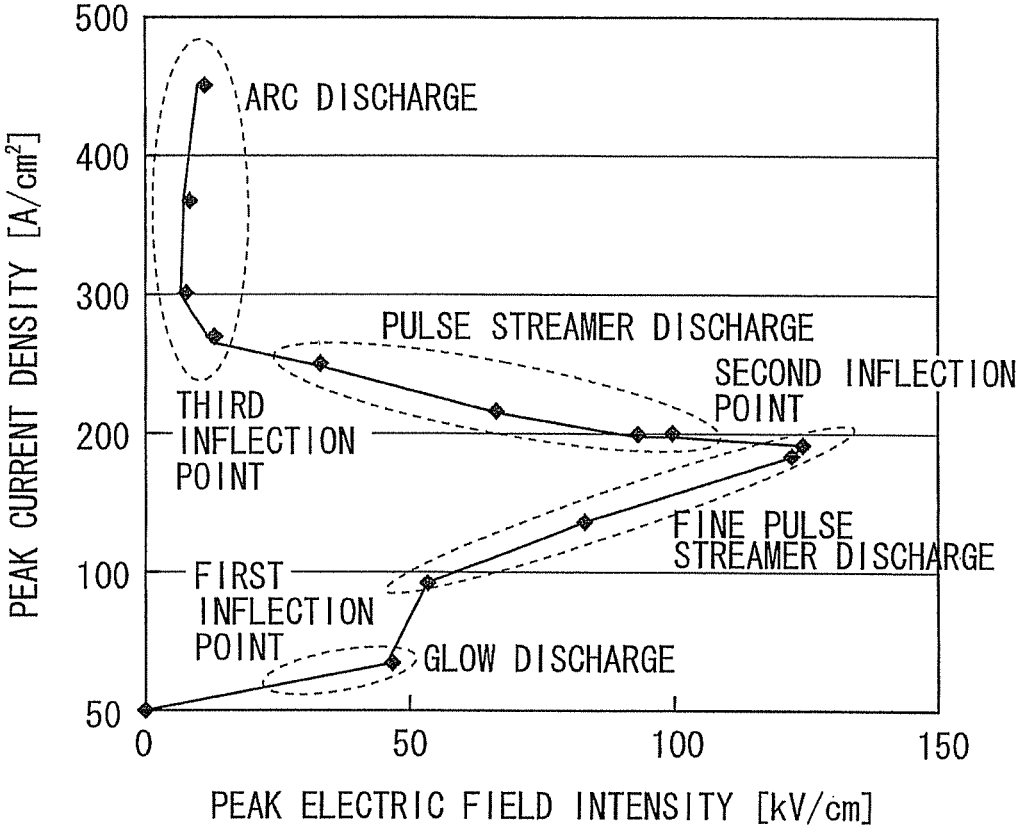
FIG. 22 is a graph showing a relationship between a peak electric field intensity and a peak current density.

FIG. 22 is a graph showing a relationship between a peak electric field intensity and a peak current density. In general, the discharge state varies depending on a length of the pulse width, a level of a temperature, a level of a voltage, a level of a current, and a level of an atmospheric pressure. In addition, the graph shown in FIG. 22 is created when a discharge is caused under the condition of a metal electrode discharge gap: 1.5 mm, a plug anode area: ϕ2 mm, a plug cathode area: 2×3 mm, a pressure: 10 atmospheres, a temperature: 60° C. As shown in FIG. 22, as a voltage is applied between the electrodes, a current starts flowing gradually due to the glow discharge from a certain peak electric field intensity. As the voltage is further raised, the discharge transition to the fine pulse streamer discharge occurs through an inflection point (first inflection point) where the peak current density rises rapidly, and a rise rate of the peak current density increases. As the voltage is further raised, the discharge transition to the pulse streamer discharge occurs through an inflection point (second inflection point) where the peak electric field intensity starts decreasing gradually, and the peak current density increases. As the voltage is further raised, the discharge transition to the arc discharge occurs through an inflection point (third inflection point) where the peak electric field intensity hardly changes while only the peak current density increases.

In this specification, the discharge generated between the discharge start and the first inflection point is referred to as the "glow discharge", the discharge generated between the first inflection point and the second inflection point is referred to as the "fine pulse streamer discharge", the discharge generated between the second inflection point and the third inflection point is referred to as the "pulse streamer discharge", and the discharge generated after the third inflection point is referred to as the "arc discharge".

<Second Embodiment of Discharge Part>

Figure 5:
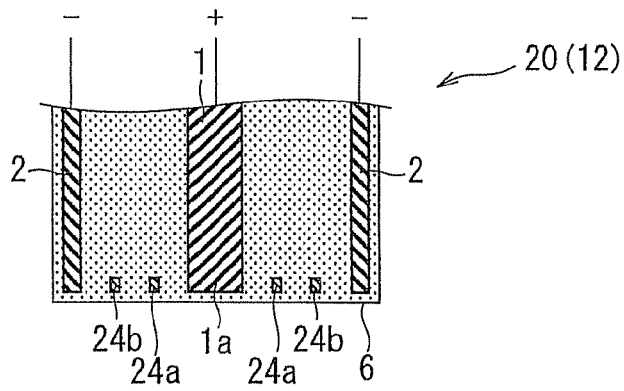
FIG. 5 is a partial cross-sectional view schematically showing a second embodiment of a discharge part used in a plasma igniter of the present invention.

FIG. 5 is a partial cross-sectional view schematically showing a second embodiment of a discharge part used in a plasma igniter according to the present invention. A plurality of floating electrodes 24*a* and 24*b* are arranged between the anode tip end part 1*a* and the cathode 2, at the discharge tip end 12 of a discharge part 20 shown in FIG. 5. Thus, in the plasma igniter according to the present invention, the number of the floating electrode arranged at the discharge tip end of the discharge part is not limited to "one", and it is preferable that the plurality of floating electrodes be provided. That is, by sequentially increasing the number of the floating electrodes, a preferable arrangement can be made for a large-sized gasoline engine having a larger volume combustion chamber.

<Third and Fourth Embodiments of Discharge Parts>

Figure 6:
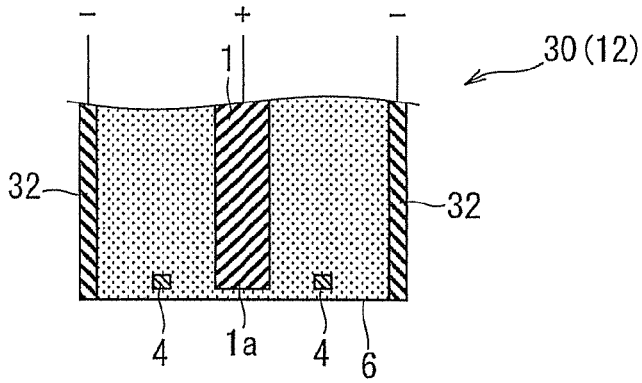
FIG. 6 is a partial cross-sectional view schematically showing a third embodiment of a discharge part used in a plasma igniter of the present invention.
Figure 7:
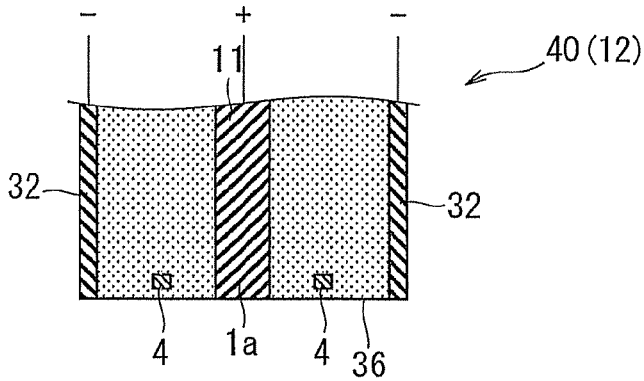
FIG. 7 is a partial cross-sectional view schematically showing a fourth embodiment of a discharge part used in a plasma igniter of the present invention.

FIG. 6 is a partial cross-sectional view schematically showing a third embodiment of a discharge part used in a plasma igniter according to the present invention. FIG. 7 is a partial cross-sectional view schematically showing a fourth embodiment of a discharge part used in a plasma igniter according to the present invention. At the discharge tip end 12 of a discharge part 30 shown in FIG. 6, while the anode tip end part 1*a* is covered with the base material 6, an end and a side surface of a cathode 32 are not covered with the base material and exposed to the combustion chamber. In addition, at the discharge end 12 of a discharge part 40 shown in FIG. 7, all of the anode tip end part 1*a*, the tip end and the side surface of the cathode 32 are not covered with the base material and are exposed to the combustion chamber. Thus, in the plasma igniter according to the present invention, the anode tip end part and/or the tip end and the side surface of the cathode may not be covered with the base material, and may be exposed to the combustion chamber. This is preferable because a high density electron can be emitted from the metal cathode 32 with low power.

<Fifth Embodiment of Discharge Part>

Figure 8:
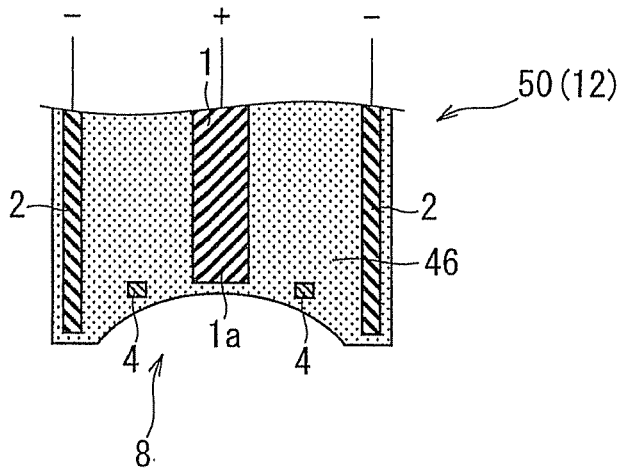
FIG. 8 is a partial cross-sectional view schematically showing a fifth embodiment of a discharge part used in a plasma igniter of the present invention.

FIG. 8 is a partial cross-sectional view schematically showing a fifth embodiment of a discharge part used in a plasma igniter according to the present invention. At the discharge tip end 12 of a discharge part 50 shown in FIG. 8, a recessed part 8 is formed by forming an end part of a base material 46 into a recessed shape. When the discharge tip end of the discharge part is formed into the recessed shape, a discharge creeping distance can be largely ensured as compared with a case of using the discharge part having the same-diameter discharge end. Therefore, it is preferable because more radicals can be discharged, and a lean combustion effect can be improved.

<Sixth Embodiment of Discharge Part>

Figure 9:
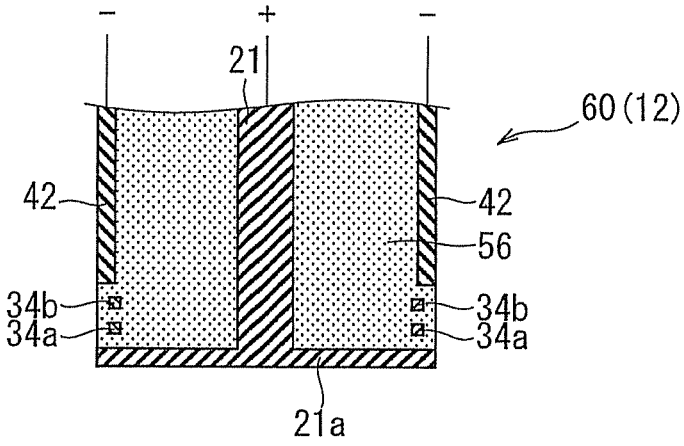
FIG. 9 is a partial cross-sectional view schematically showing a sixth embodiment of a discharge part used in a plasma igniter of the present invention.

FIG. 9 is a partial cross-sectional view schematically showing a sixth embodiment of a discharge part used in a plasma igniter according to the present invention. At the discharge tip end 12 of the discharge part 60, an anode tip end part 21*a* is formed into a sheet shape which is perpendicular to an axial direction of an anode 21. In addition, a plurality of floating electrodes 34*a*, 34*b* and a cathode 42 are arranged at certain intervals on the rear end side of a discharge part 60 (opposite direction of the discharge tip end 12). Thus, the anode tip end part, the floating electrodes and the cathode may be configured to be sequentially arranged along the axial direction of the anode, so that a preferable arrangement can be made for a large-sized gasoline engine having a combustion chamber which is large in volume or complicated in shape. According to the other embodiments, the bar end of the bar-shaped part of the anode serves as the discharge end, and the discharge contributing parts of the cathode and the floating electrode are arranged concentrically around the center of the bar end, but according to this embodiment, a sheet end of the sheet-shaped part of the anode serves as the discharge end, and discharge contributing parts of the cathode and the floating electrode are extended along a circumferential extension path, maintaining certain distances from the sheet end.

<Seventh Embodiment of Discharge Part>

Figure 10:
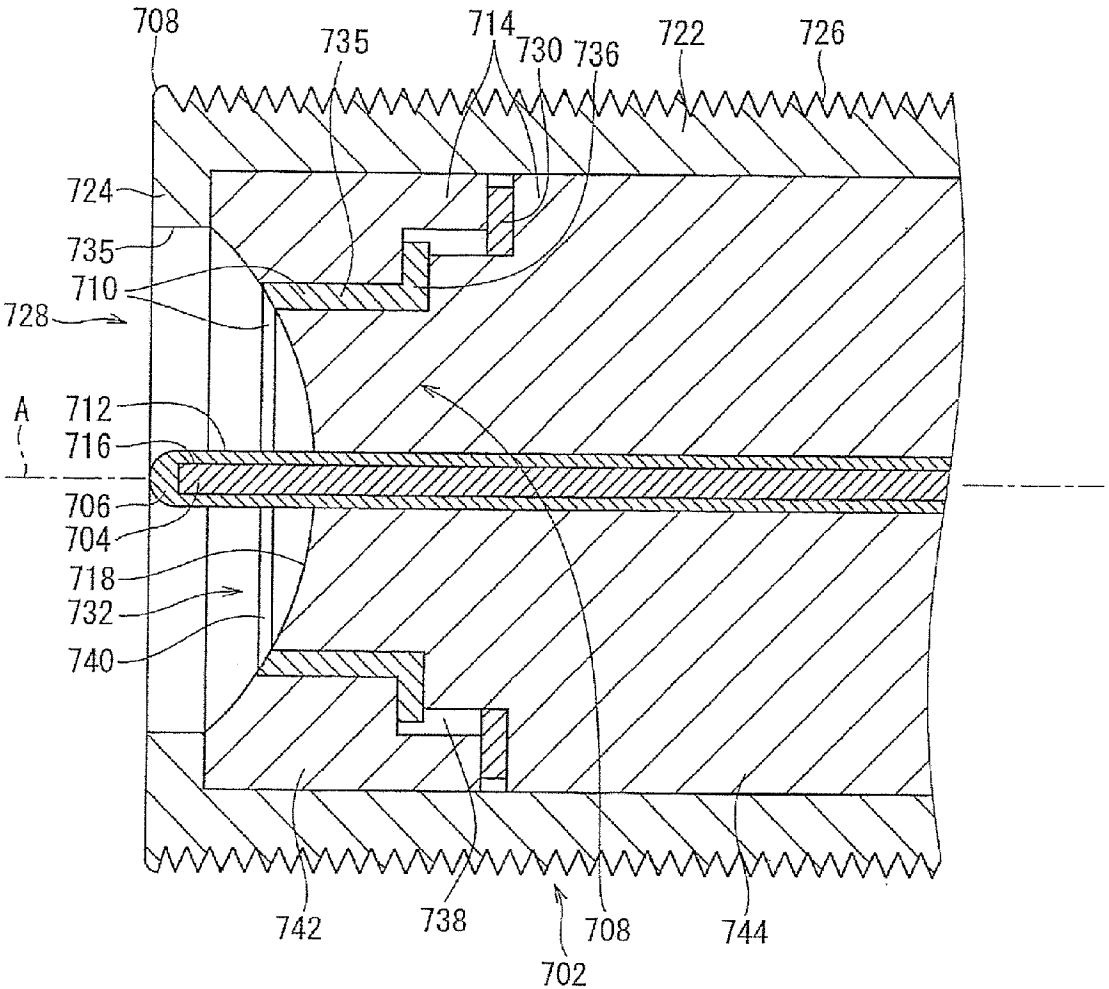
FIG. 10 is a cross-sectional view of a discharge tip end of a discharge part of a seventh embodiment.
Figure 11:
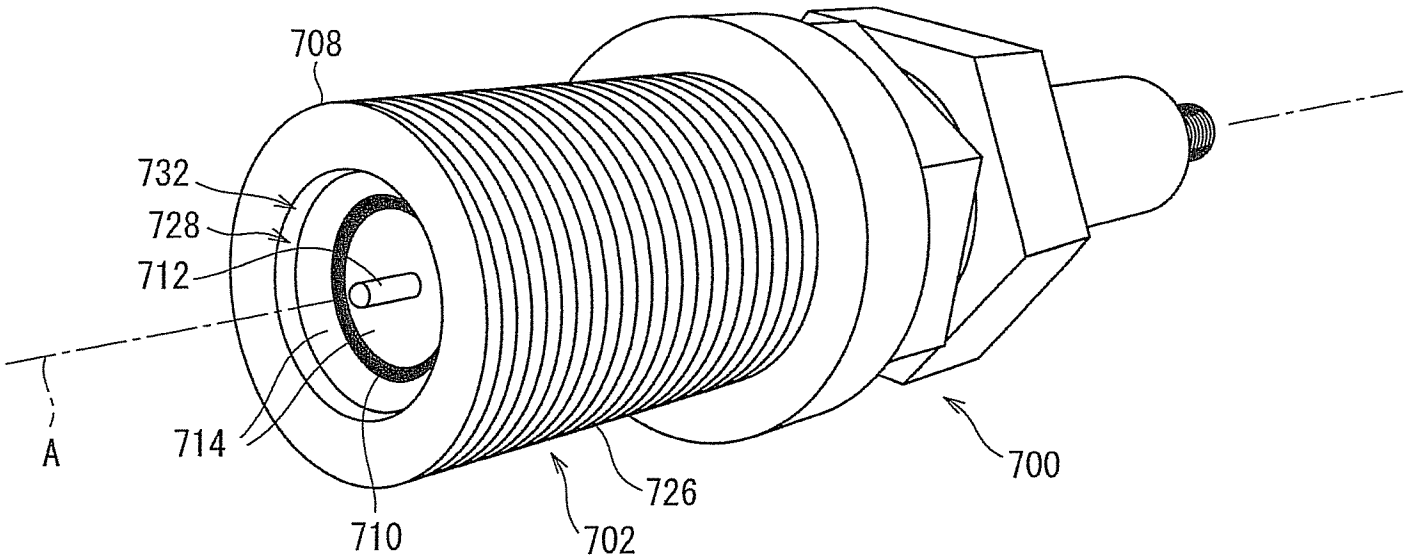
FIG. 11 is a perspective view of the discharge part of the seventh embodiment.

FIGS. 10 and 11 are schematic views showing a seventh embodiment of a discharge part used in a plasma igniter according to the present invention. FIG. 11 is a cross-sectional view of a discharge tip end 702 of a discharge part 700, and FIG. 10 is a perspective view of the discharge part 700.

As shown in FIGS. 10 and 11, the discharge tip end 702 has an anode 704, a cover 706 to inhibit an arc discharge, a cathode 708 and a floating electrode 710. A composite body 712 of the anode 704 and the cover 706 (hereinafter, referred to as the "anode composite body"), the cathode 708 and the floating electrode 710 are mutually fixed by a base material 714.

The discharge tip end 702 of the discharge part 700 is rotation symmetrical with respect to an axis A.

(Anode 704)

The anode 704 is a bar-shaped conductive body composed of a platinum-rhodium alloy, tungsten and the like. The anode 704 is positioned at the axis A, and extends in an axial direction.

The anode 704 is covered with the cover 706 made of ceramics such as alumina and zirconia. The cover 706 is preferably made of ceramics having few pore and low content of impurities. Consequently, the arc discharge is prevented from being generated, and the anode 704 is protected. The cover 706 is preferably made of ceramics having a high dielectric constant and low electric conductivity.

The cover 706 may be produced by any method, but it is desirable to be produced in such a manner that a film-shaped ceramic compact is formed on a surface of the anode 704 by a gel-casting method, and the film-shaped ceramic compact and the anode 704 are fired integrally.

A part other than an anode tip end part 716 in the anode 706 does not serve as a start point of the pulse discharge. Therefore, while at least the anode tip end part 716 serving as a discharge end which contributes to the pulse discharge in the anode 704 needs to be covered with cover 706, the whole anode 704 are not necessarily covered with the cover 706. For example, in the anode 704, only a part projecting from a surface 718 of the base material 714 may be covered with the cover.

The anode 704 projects from the surface 718 of the base material 714. Thus, the pulse discharge largely spreads. This contributes to efficient non-equilibrium plasma generation.

(Cathode 708)

The cathode 708 is a conductive body including a cylindrical part 722 and a flat annular part 724. The cylindrical part 722 extends in the axial direction, and a male screw 726 which mates with a female screw formed at the igniter part 100 is formed on an outer surface of the cylindrical part 722. The flat annular part 724 is perpendicular to the axis A, and a round hole 728 is provided around the axis A, in the flat annular part 724. The flat annular part 724 is positioned on the tip end side of the cylindrical part 722 and extends from the cylindrical part 722 to radial inner side.

The cathode 708 serves also as a housing of the discharge part 700 to hold the anode composite body 712, the floating electrode 710, the base material 714 and a seal 730 inside the cathode 708. In the round hole 728 of the flat annular part 724, a recessed part 732 formed in the base material 714, the anode composite body 712 projecting from the recessed part 732, and the floating electrode 710 exposed to the recessed part 732 are exposed.

A discharge contributing part 734 which serves as a terminal end of the pulse discharge and contributes to the pulse discharge in the cathode 708 is positioned at an end part of the round hole 728 of the flat annular part 724. The discharge contributing part 734 is a first distance away from the anode tip end part 716 along a surface of the discharge part 700 (a bottom of the recessed part 732 in this embodiment) like the other embodiments.

(Floating electrode 710)

The floating electrode 710 is a conductive body having a cylindrical part 735 and a flat annular part 736. The cylindrical part 735 extends in the axial direction. The flat annular part 736 is perpendicular to the axis A, and a round hole 738 around the axis A is provided in the flat annular part 736. The flat annular part 736 is positioned on the rear end side of the cylindrical part 735, and extends from the cylindrical part 735 to the radial outer side. The tip end side of the cylindrical part 735 is exposed to the bottom of the recessed part 732.

A part 740 serving as the terminal end of the pulse discharge and contributing to the pulse discharge (hereinafter, referred to as the "discharge contributing part") in the floating electrode 710 is positioned on the tip end side of the cylindrical part 735. The discharge contributing part 740 is a second distance which is shorter than the first distance, away from the anode tip end part 716 along the surface of the discharge part 700 (the bottom of the recessed part 732 in this embodiment) like the other embodiments, and it is interposed between the anode tip end part 716 of the anode 704 and the discharge contributing part 734 of the cathode 708.

(Base Material 714 and Seal 730)

The base material 714 is an insulating body made of ceramics such as alumina. The base material 714 includes a tip end side member 742 and a rear end side member 744. The floating electrode 734 is sandwiched between the tip end side member 742 and the rear end side member 744. A part in which the floating electrode 734 is not provided between the tip end side member 742 and the rear end side member 744 is filled with the seal 730, and the tip end side member 742, the rear end side member 744, the floating electrode 734 and the seal 730 are housed inside the cathode 708 in an integrated state.

The base material 714 has a housing hole at a position of the axis A to house the anode composite body 712 extending in the axial direction. The recessed part 732 having a smooth curve surface as the bottom surface, which is rotation symmetrical with respect to the axis A, is formed on the tip end side of the base material 714.

<Eighth Embodiment of Discharge Part>

Figure 12:
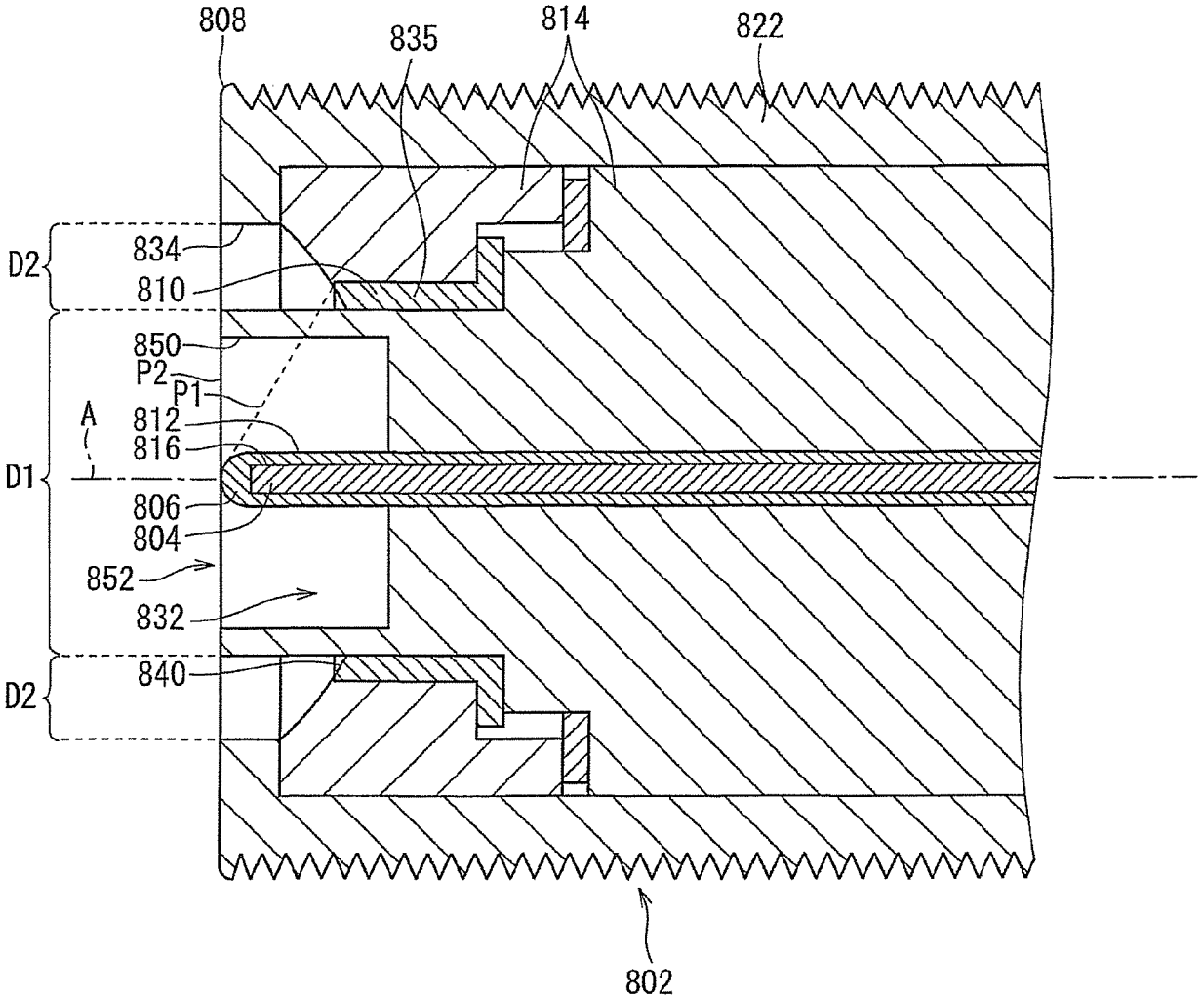
FIG. 12 is a cross-sectional view of a discharge tip end of a discharge part of an eighth embodiment.
Figure 13:
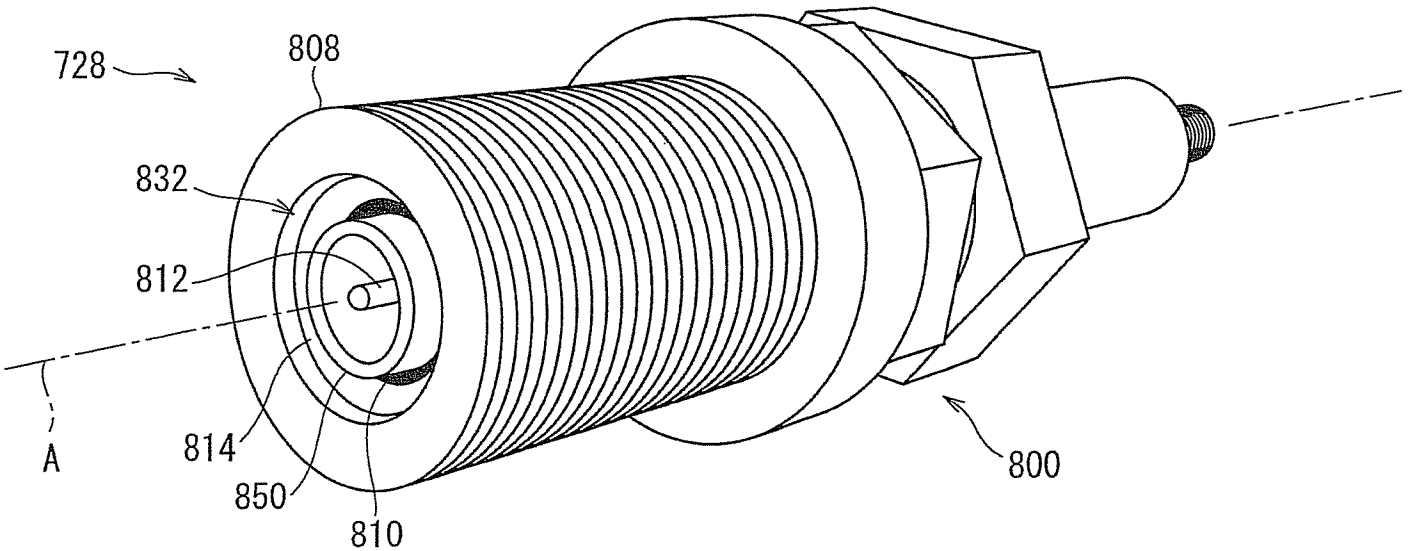
FIG. 13 is a perspective view of the discharge part of the eighth embodiment.

FIGS. 12 and 13 are schematic views of an eighth embodiment of a discharge part used in a plasma igniter according to the present invention. FIG. 12 is a cross-sectional view of a discharge tip end 802 of a discharge part 800, and FIG. 13 is a perspective view of the discharge part 800.

As shown in FIGS. 12 and 13, similar to the seventh embodiment, the discharge tip end 802 has an anode 804, a cover 806 to inhibit the arc discharge, a cathode 808 and a floating electrode 810. While configurations, materials, positions and production methods of the anode 804, the cover 806, the cathode 808 and the floating electrode 810 are the same as those of the seventh embodiment, there is a case where the cover 806 is omitted. An anode composite body 812 composed of the anode and the cover 806, the cathode 808, and the floating electrode 810 are mutually fixed by a base material 814.

The discharge tip end 802 of the discharge part 800 is rotation symmetrical with respect to the axis A.

A part of the base material 814 projects to serve as a dielectric barrier 850 to prevent the arc discharge from being generated between the anode 804 and the floating electrode 810. The base material 814 and the dielectric barrier 850 may be different bodies. When the base material 814 and the dielectric barrier 850 are different bodies, the dielectric barrier 850 is also fixed by the base material 814.

The dielectric barrier 850 has a cylindrical shape, extends in the axial direction, is disposed between the anode 804 (anode composite body 812) and the floating electrode 810, and is arranged coaxially with the anode 804, a cylindrical part 822 of the cathode 808, and a cylindrical part 835 of the floating electrode 810. The dielectric barrier 850 is preferably made of ceramics such as alumina and zirconia.

As the dielectric barrier 850 may be arranged between the anode 804 and the floating electrode 810, it is desirable to be arranged so as to be in contact with the floating electrode 810. Thus, the dielectric barrier 850 is arranged at a position in which a degree of concentration of the electric field is low, so that the dielectric barrier 850 is prevented from being damaged.

A tip end side of the dielectric barrier 850 projects from a surface P1 provided by connecting a tip end side of the anode composite body 812 (a tip end side of the anode 804 when the cover 806 is omitted) to a tip end side of the floating electrode 810, and reaches a surface P2 provided by connecting the tip end side of the anode 804 to the tip end side of the cathode 808. The tip end side of the dielectric barrier 850 may project from the surface P2. Consequently, a discharge contributing part 840 of the floating electrode 810 and a discharge contributing part 834 of the cathode 808 cannot be seen from an anode tip end 816 of the anode 804, so that the discharge contributing part 840 of the floating electrode 810 and the discharge contributing part 834 of the cathode 808 are shielded from the anode tip end part 816 of the anode 804. This prevents the arc discharge from being generated between the anode 804 and the floating electrode 810, and between the anode 804 and the cathode 808.

The anode composite body 812 (anode 804 when the cover 806 is omitted) is not covered with the dielectric barrier 850 but exposed to the combustion chamber 130. Therefore, the dielectric barrier 850 has an opening 852 to expose the anode composite body 812. The opening 852 is positioned so as not to hinder the shielding of the discharge contributing part 840 of the floating electrode 810 and the discharge contributing part 834 of the cathode 808 from the anode tip end part 816 of the anode 804, that is, positioned such that the discharge contributing part 840 of the floating electrode 810 and the discharge contributing part 834 of the cathode 808 fall within a range so as not to be seen from the anode tip end part 816 of the anode 804. As shown in FIGS. 12 and 13, when the dielectric barrier 850 has a cylindrical shape, an opened tail end of the cylinder corresponds to the opening 852.

The cathode 808 is not shielded from the floating electrode 810 by the dielectric barrier 850.

When the discharge part 800 is employed, in an initial stage, a relatively low pulse voltage is applied from the ignition power supply 200 between the anode 804 and the cathode 808, and the pulse discharge is generated between the anode tip end part 816 and the floating electrode 810 (in a first discharge region D1). At this time, since the discharge contributing part 840 of the floating electrode 810 is shielded from the anode tip end part 816 of the anode 804, the pulse discharge is not likely to become the arc discharge. This prevents the anode composite body 812 from being damaged by the arc discharge, and enables a streamer to sufficiently grow in the first discharge region D1.

In a second stage, a relatively high pulse voltage is applied from the ignition power supply 200 between the anode 804 and the cathode 808, and a pulse discharge is generated between the floating electrode 810 and the cathode 808 (in a second discharge region D2). While this pulse discharge is preferably the pulse streamer discharge or the arc discharge, the arc discharge is not likely to be generated in the first discharge region D1 even when the arc discharge is generated in the second discharge region D2 because the discharge contributing part 840 of the floating electrode 810 is shielded from the anode tip end part 816 of the anode 804. This enables the ignition to be implemented without generating the arc discharge in the first discharge region D1, and prevents the anode composite body 812 from being damaged by the arc discharge. In addition, at the same time as the pulse discharge in the second discharge region D2 or later than the pulse discharge in the second discharge region D2, a discharge other than the arc discharge may be generated in the first discharge region D1.

EXAMPLE

Hereinafter, while the present invention will be described specifically based on an example, the present invention is not limited to this example.

Example 1

Figure 14:
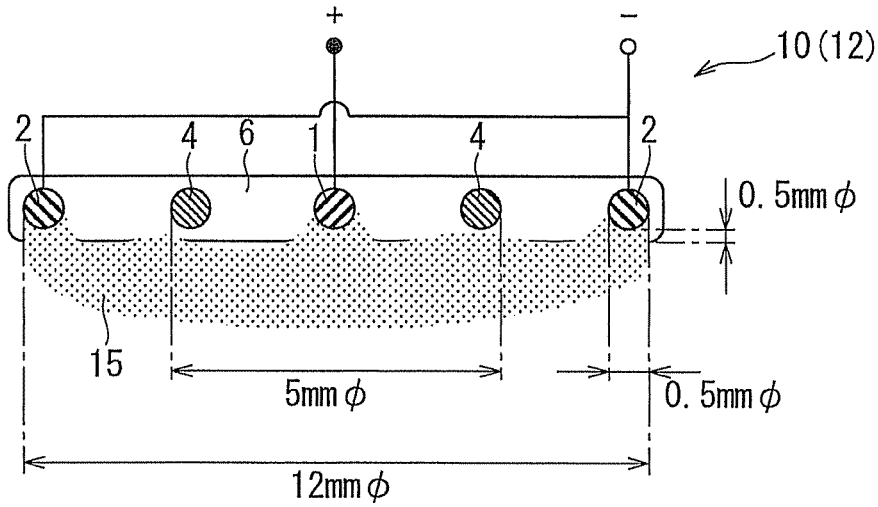
FIG. 14 is a schematic view showing one example of a state where a pulse voltage is applied to the discharge part of the first embodiment.
Figure 18:
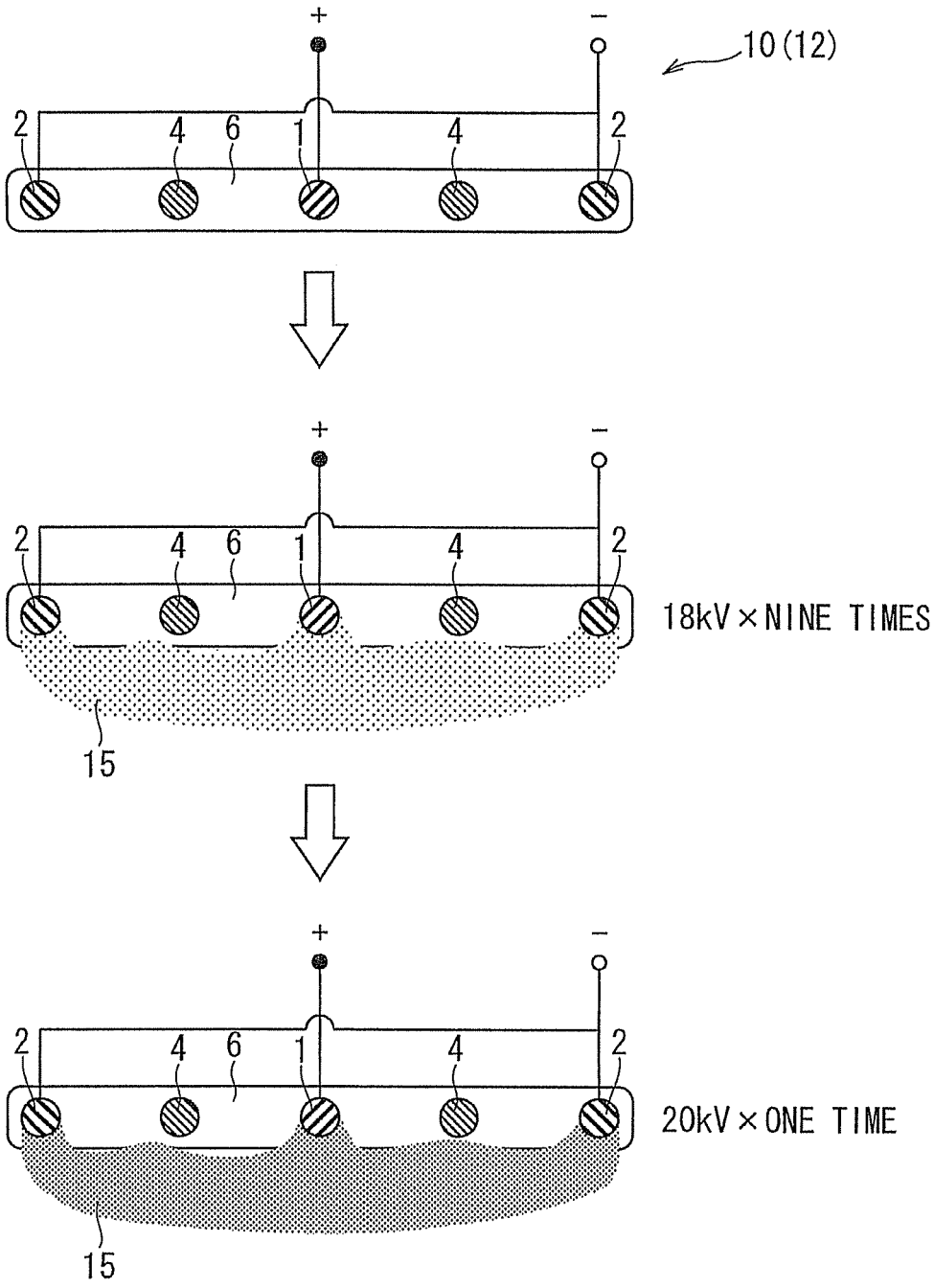
FIG. 18 is a schematic view showing a chronological change when a pulse voltage is applied to a discharge part of a plasma igniter of an example 1.

The discharge part 10 having the configuration shown in FIG. 14 was mounted on a single-cylinder 250 cc gasoline engine. A mixture gas was ignited and burnt by applying pulse voltages in such a manner that a voltage of 18 kV was applied nine times and a voltage of 20 kV was applied one time. A schematic view showing a chronological change while the pulse voltages were applied to the discharge part is shown in FIG. 18.

Comparison Example 1

The discharge part 60 having the configuration shown in FIG. 16 was mounted on the single-cylinder 250 cc gasoline engine. A mixture gas was ignited and burnt by applying pulse voltages in such a manner that a voltage of 13 kV was applied nine times and a voltage of 15 kV was applied one time. A schematic view showing a chronological change while the pulse voltages were applied to the discharge part is shown in FIG. 19.

(Evaluation Result)

Figure 19:
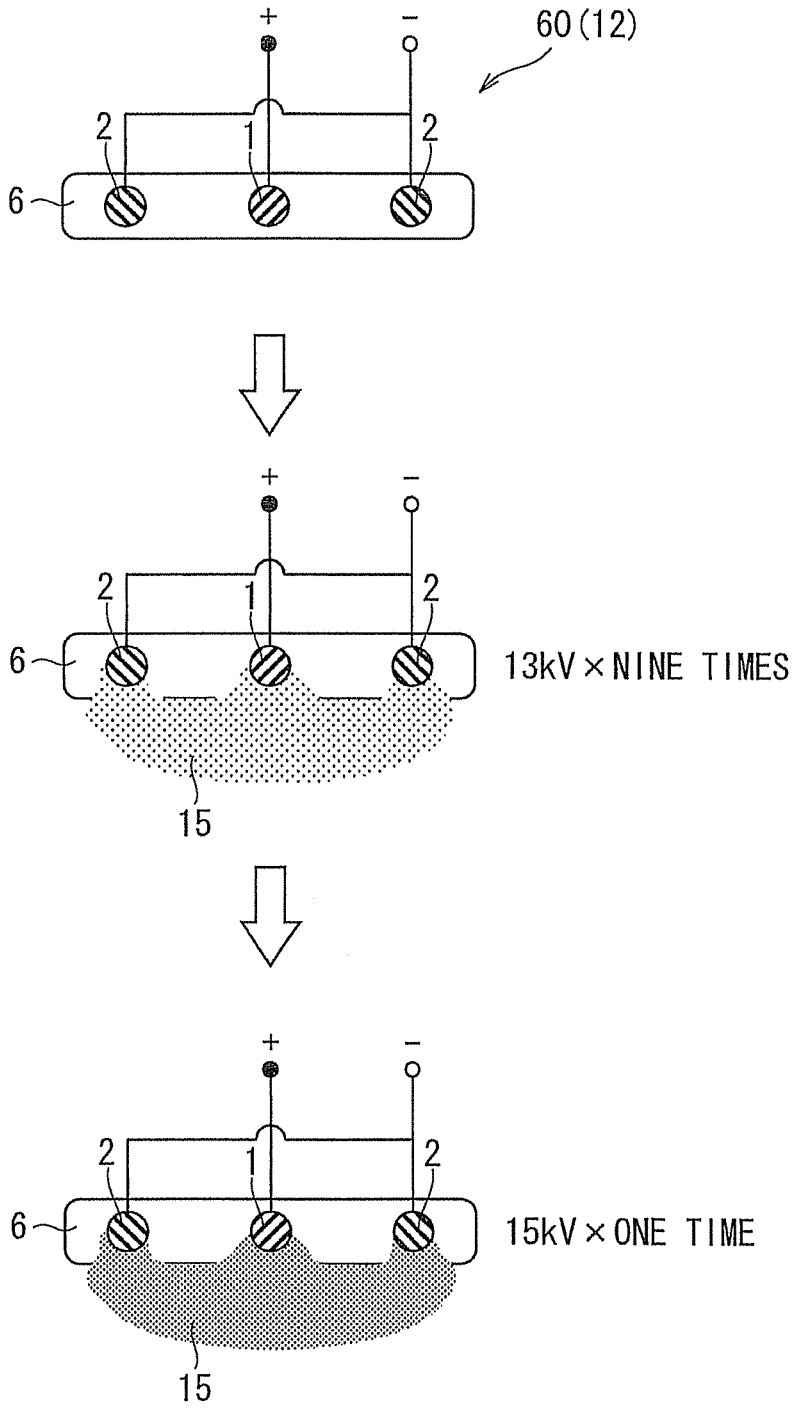
FIG. 19 is a schematic view showing a chronological change when a pulse voltage is applied to a discharge part of a plasma igniter of a comparison example 1.

In each case of Example 1 and Comparison example 1, discharge regions 15 and 17 were formed in predetermined positions as shown in FIGS. 18 and 19, and the mixture gas could be ignited and burnt.

Figure 20:
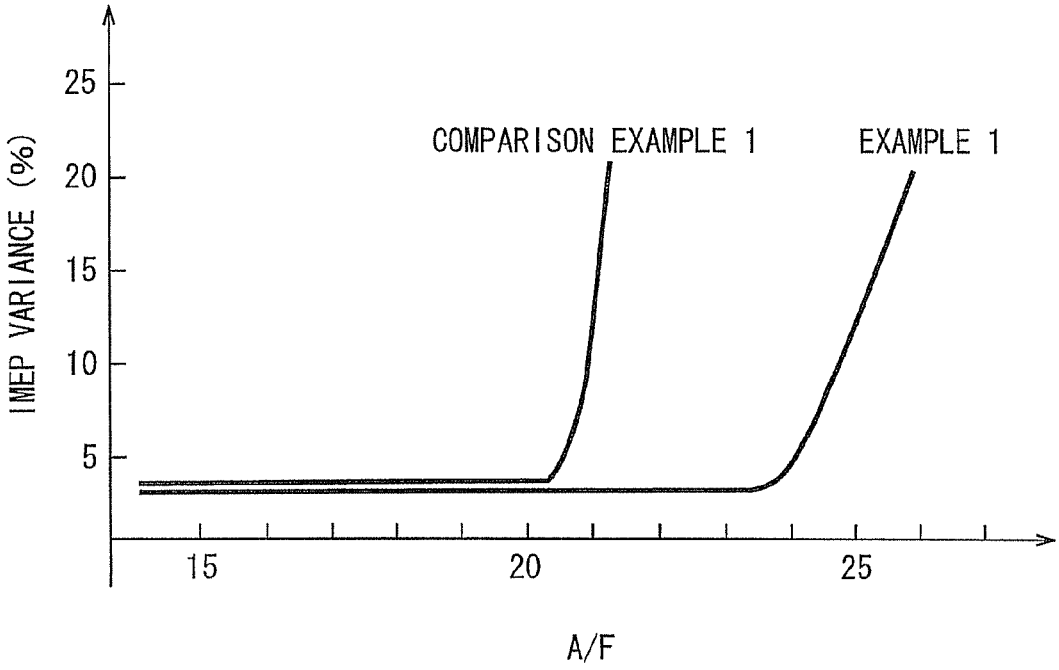
FIG. 20 is a graph provided by plotting an IMEP variance (%) to an air/fuel ratio (A/F).

FIG. 20 is a graph in which IMEP variances (%) are plotted on an air-fuel ratio (A/F). As shown in FIG. 20, in Comparison example 1, a maximum air-fuel ratio (A/F) capable of causing the ignition (operation) in a stable region in which the IMEP (Indicated Mean Effective Pressure) variance is less than 5% is 20, while in Example 1, it is clear that the ignition (operation) can be stably caused up to a maximum air-fuel ratio (A/F) of 23.

That is, in the plasma igniter according to the present invention, even when a mixture gas in which the air-fuel ratio (A/F) is set high is ignited and burnt, lean combustion can be implemented in a stable state. Therefore, the plasma igniter according to the present invention is suitable for an internal-combustion engine such as a lean burn engine, and contributes to improvement in fuel cost and reduction in amount of emitted carbon dioxide ($CO_2$).

Industrial Applicability

A plasma igniter according to the present invention is suitable for an internal-combustion engine such as a car gasoline engine.

DESCRIPTION OF REFERENCE NUMERALS

1, 11, 21*a*, 81, 704: ANODE, 1*a*, 11*a*, 716: ANODE TIP END PART, 2, 32, 42, 82, 708: CATHODE, 4, 24*a*, 24*b*, 34*a* 34*b*, 710: FLOATING ELECTRODE, 6, 26, 36, 46, 56, 714: BASE MATERIAL, 8, 732: RECESSED PART, 10, 20, 30, 40, 50, 60, 700: DISCHARGE PART, 12,702: DISCHARGE TIP END, 14: INSULATOR, 15, 17: DISCHARGE REGION 16: TERMINAL, 18: MAIN METAL FITTING, 22: SCREW PART, 25, 35, 83: STREAMER, 51: FIRST DISCHARGE REGION, 52: SECOND DISCHARGE REGION, 100: IGNITER PART, 110: INLET PIPE, 120: OUTLET PIPE, 130: COMBUSTION CHAMBER, 140: PISTON, 150: CYLINDER, 160: INLET VALVE, 170: OUTLET VALVE, 200: IGNITION POWER SUPPLY

The invention claimed is:

1. An ignition device for an internal-combustion engine comprising:

an electrode structure body comprising an anode, a cathode and a floating electrode; and a pulse power supply to apply a pulse voltage between said anode and said cathode; wherein:

a discharge contributing part of said cathode is positioned to be a first distance away from a discharge end of said anode along a surface of said electrode structure body;

a discharge contributing part of said floating electrode is positioned to be a second distance shorter than said first distance, away from the discharge end of said anode along the surface of said electrode structure body, and interposed between the discharge end of said anode and the discharge contributing part of said cathode; and said pulse power supply applies a relatively low pulse voltage between said anode and said cathode to generate a pulse discharge in a first discharge region between the discharge end of said anode and the discharge contributing part of said floating electrode, and then applies a relatively high pulse voltage thereto to generate a pulse discharge in a second discharge region between the discharge end of said anode and the discharge contributing part of said cathode.

2. The ignition device for the internal-combustion engine according to claim 1, wherein said electrode structure body further comprises a cover made of ceramics produced by burning a film-shaped compact formed by gel-casting method to cover the discharge end of said anode.

3. The ignition device for the internal-combustion engine according to claim 1, wherein:

said anode comprises a bar-shaped part, and a bar end of the bar-shaped part of said anode is the discharge end of said anode; and the discharge contributing part of said cathode and the discharge contributing part of said floating electrode are arranged concentrically around the bar end of said bar-shaped part.

4. The ignition device for the internal-combustion engine according to claim 1, wherein:

said anode comprises a sheet-shape part, and a sheet end of the sheet-shaped part of said anode is the discharge end of said anode; and the discharge contributing part of said cathode and the discharge contributing part of said floating electrode extend, keeping constant distances from the sheet end of said sheet-shaped part.

5. The ignition device for the internal-combustion engine according to claim 1, wherein a plurality of said floating electrodes are interposed between the discharge end of said anode and the discharge contributing part of said cathode.

6. The ignition device for the internal-combustion engine according to claim 1, wherein said electrode structure body further comprises a base material made of ceramics to mutually fix said anode, said cathode, and said floating electrode.

7. The ignition device for the internal-combustion engine according to claim 1, wherein a recessed part is formed in a surface of said electrode structure body.

8. An ignition device for an internal-combustion engine comprising:

an electrode structure body comprising an anode, a cathode, a floating electrode and a dielectric barrier; and a pulse power supply to apply a pulse voltage between said anode and said cathode; wherein:

a discharge contributing part of said cathode is positioned to be a first distance away from a discharge end of said anode along a surface of said electrode structure body;

a discharge contributing part of said floating electrode is positioned to be a second distance shorter than said first distance, away from the discharge end of said anode along the surface of said electrode structure body, and interposed between the discharge end of said anode and the discharge contributing part of said cathode;

said dielectric barrier is arranged between said anode and said floating electrode to shield the discharge contributing part of said cathode and the discharge contributing part of said floating electrode from the discharge end of said anode, and has an opening at a position so as not to hinder the shielding of the discharge contributing part of said cathode and the discharge contributing part of said floating electrode from the discharge end of said anode; and said pulse power supply applies a relatively low pulse voltage between said anode and said cathode to generate a pulse discharge in a first discharge region between the discharge end of said anode and the discharge contributing part of said floating electrode, and then applies a relatively high pulse voltage thereto to generated a pulse discharge in a second discharge region between the discharge contributing part of said floating electrode and the discharge contributing part of said cathode.

* * * * *